US007218195B2

(12) United States Patent
Laskaris et al.

(10) Patent No.: US 7,218,195 B2
(45) Date of Patent: May 15, 2007

(54) METHOD AND APPARATUS FOR MAGNETIZING A PERMANENT MAGNET

(75) Inventors: Evangelos Trifon Laskaris, Niskayuna, NY (US); Paul Shadforth Thompson, Stephentown, NY (US); Liang Li, Niskayuna, NY (US); Kathleen Melanie Amm, Clifton Park, NY (US); Bulent Aksel, Clifton Park, NY (US); Michael Anthony Palmo, Jr., Ballston Spa, NY (US)

(73) Assignee: General Electric Company, Niskayuna, NY (US)

( * ) Notice: Subject to any disclaimer, the term of this patent is extended or adjusted under 35 U.S.C. 154(b) by 307 days.

(21) Appl. No.: 10/674,495

(22) Filed: Oct. 1, 2003

(65) Prior Publication Data

US 2005/0073383 A1 Apr. 7, 2005

(51) Int. Cl.
*H01F 5/00* (2006.01)

(52) U.S. Cl. ..... 335/300

(58) Field of Classification Search ..... 335/285, 335/296–300; 336/55–62
See application file for complete search history.

(56) References Cited

U.S. PATENT DOCUMENTS

| | | | | |
|---|---|---|---|---|
| 3,056,071 | A * | 9/1962 | William et al. | 335/300 |
| 3,899,762 | A | 8/1975 | Studders | |
| 4,039,990 | A * | 8/1977 | Philp | 336/60 |
| 4,496,395 | A | 1/1985 | Croat | |
| 4,540,453 | A | 9/1985 | Boredelon et al. | |
| 4,818,966 | A | 4/1989 | Miyamoto et al. | |
| 4,827,235 | A | 5/1989 | Inomata et al. | |
| 4,896,130 | A * | 1/1990 | Ermilov et al. | 335/300 |
| 5,252,924 | A | 10/1993 | Sakurai et al. | |
| 5,283,544 | A | 2/1994 | Sakurai et al. | |
| 5,317,297 | A | 5/1994 | Kaufman et al. | |
| 5,343,180 | A | 8/1994 | Fukumoto et al. | |
| 5,383,978 | A | 1/1995 | Yamamoto et al. | |
| 5,631,616 | A | 5/1997 | Ohta et al. | |
| 5,680,086 | A | 10/1997 | Allis et al. | |
| 6,120,620 | A | 9/2000 | Benz et al. | |
| 6,157,281 | A | 12/2000 | Katznelson et al. | |
| 6,163,240 | A | 12/2000 | Zuk et al. | |
| 6,255,670 | B1 | 7/2001 | Srivastava et al. | |
| 6,259,252 | B1 | 7/2001 | Laskaris et al. | |
| 6,429,761 | B2 | 8/2002 | Laskaris et al. | |
| 6,518,867 | B2 | 2/2003 | Laskaris et al. | |
| 6,525,634 | B2 | 2/2003 | Laskaris et al. | |
| 2002/0021129 | A1 | 2/2002 | Laskaris et al. | |

FOREIGN PATENT DOCUMENTS

| | | |
|---|---|---|
| EP | 623939 | 11/1994 |
| JP | 02141501 | 5/1990 |
| JP | 03170643 | 7/1991 |
| JP | 10174681 | 6/1998 |
| WO | 0048208 | 8/2000 |

OTHER PUBLICATIONS

Abstract of Japan 2002-536,842.
"Electrical Engineering Concepts and Applications," A. Bruce Carlson et al., Addison-Wesley Publishing Co., 1990, pp. 119-121.

(Continued)

*Primary Examiner*—Ramon M. Barrera
(74) *Attorney, Agent, or Firm*—Jean K. Testa; Curtis B. Brueske

(57) ABSTRACT

A magnetizing coil unit and a method of making a magnetizing coil unit is provided. The coil includes a solenoid coil having a coiled copper sheet in which the width of the copper sheet is equal to the height of the solenoid coil. A magnetizing assembly includes a plurality of magnetizing coil units.

2 Claims, 5 Drawing Sheets

OTHER PUBLICATIONS

"Magnetic Materials and Their Properties," E.A. Brandes et al., Smithells Metal Reference Book, Butterworth-Heinemann Ltd., 1992, p. 20-6.

"Permanent Magnet Assembly and Method of Making Thereof," Laskaris et al., U.S. Appl. No. 10/309,146, filed Dec. 4, 2002.

"Permanent Magnet Assembly and Method of Making Thereof," Laskaris et al., U.S. Appl. No. 10/309,139, filed Dec. 4, 2002.

* cited by examiner

METHOD AND APPARATUS FOR MAGNETIZING A PERMANENT MAGNET

BACKGROUND OF THE INVENTION

This invention relates generally to methods and apparatus for magnetizing a permanent magnet, and specifically to magnetizing a magnet used in a magnetic resonance imaging (MRI) system.

There are various magnetic imaging systems which utilize permanent magnets. These systems include magnetic resonance imaging (MRI), magnetic resonance therapy (MRT) and nuclear magnetic resonance (NMR) systems. MRI systems are used to image a portion of a patient's body. MRT systems are generally smaller and are used to monitor the placement of a surgical instrument inside the patient's body. NMR systems are used to detect a signal from a material being imaged to determine the composition of the material.

These systems often utilize two or more permanent magnets directly attached to a support, frequently called a yoke. An imaging volume is providing between the magnets. A person or material is placed into an imaging volume and an image or signal is detected and then processed by a processor, such as a computer.

The prior art imaging systems also contain pole pieces and gradient coils adjacent to the imaging surface of the permanent magnets facing the imaging volume. The pole pieces are required to shape the magnetic field and to decrease or eliminate undesirable eddy currents which are created in the yoke and the imaging surface of the permanent magnets.

The permanent magnets used in the prior art imaging systems are frequently magnet assemblies or magnet bodies which consist of smaller permanent magnet blocks attached together by an adhesive. For example, the blocks are often square, rectangular or trapezoidal in shape. The permanent magnet body is assembled by attaching pre-magnetized blocks to each other with the adhesive. Great care is required in handling the magnetized blocks to avoid demagnetizing them. The assembled permanent magnet bodies comprising the permanent magnet blocks are then placed into an imaging system. For example, the permanent magnet bodies are attached to a yoke of an MRI system.

Since the permanent magnets are strongly attracted to iron, the permanent magnet bodies are attached to the yoke of the MRI system by a special robot or by sliding the permanent magnets along the portions of the yoke using a crank. If left unattached, the permanent magnets become flying missiles toward any iron object located nearby. Therefore, the standard manufacturing method of such imaging systems is complex and expensive because it requires a special robot and/or extreme precautions.

In order to magnetize the prior art permanent magnet, a pulsed magnetic field is used. The pulsed magnetic field is generated in a coil which is conventionally fabricated by layer winding rectangular wire. Because it is difficult to fabricate long lengths of large cross-section rectangular wires, numerous short lengths of wire are joined together to make the coil. These joints are frequently mechanically and electrically weak. Also, for thick wire winding, the layer to layer transition is difficult. These transitions often result in corner to corner contact which may damage insulation and result in a short during operation. Further, the transitions often result in a lower packing factor, losing a ¼ turn or more at the end of each layer.

An additional issue with the conventional pulsed magnetic coil is Joule heating from the pulse. Typically, the conventional pulsed coil is cooled in liquid nitrogen prior to applying the pulse to lower the resistivity of the copper coil. Below a temperature of 77 K, the resistivity of copper drops approximately eight fold. However, the passage of current during the pulse typically heats the coil above 77 K, resulting in a tremendous increase in resistivity. Therefore, in order to apply a second pulse, the coil must be remove from the precursor and cooled again.

BRIEF SUMMARY OF THE INVENTION

In accordance with one preferred aspect of the present invention, there is provided a magnetizing coil unit comprising a coiled metal sheet solenoid adapted to magnetize a permanent magnet precursor body.

In accordance with another preferred aspect of the present invention, there is provided a magnetizing assembly comprising a plurality of magnetizing coil units, each of the magnetizing coil units comprising a coiled copper sheet located in a housing, the housing containing a coolant input port in a bottom of the housing, a plurality of microchannels in the coolant input port, and a coolant output port located in a top of the housing.

In accordance with another preferred aspect of the present invention, there is provided a method of manufacturing a magnetizing coil, comprising winding a copper sheet into a coil to form a solenoid coil, the width of the copper sheet being equal to the height of the solenoid coil.

In accordance with another preferred aspect of the present invention, there is provided a method of making a permanent magnet, comprising surrounding an unmagnetized or partially magnetized precursor body with a least one magnetizing coil unit, the magnetizing coil unit comprising a coiled metal sheet solenoid, and providing a pulsed magnetic field to the precursor body to form a permanent magnet body.

DETAILED DESCRIPTION OF THE INVENTION

Figure 1:
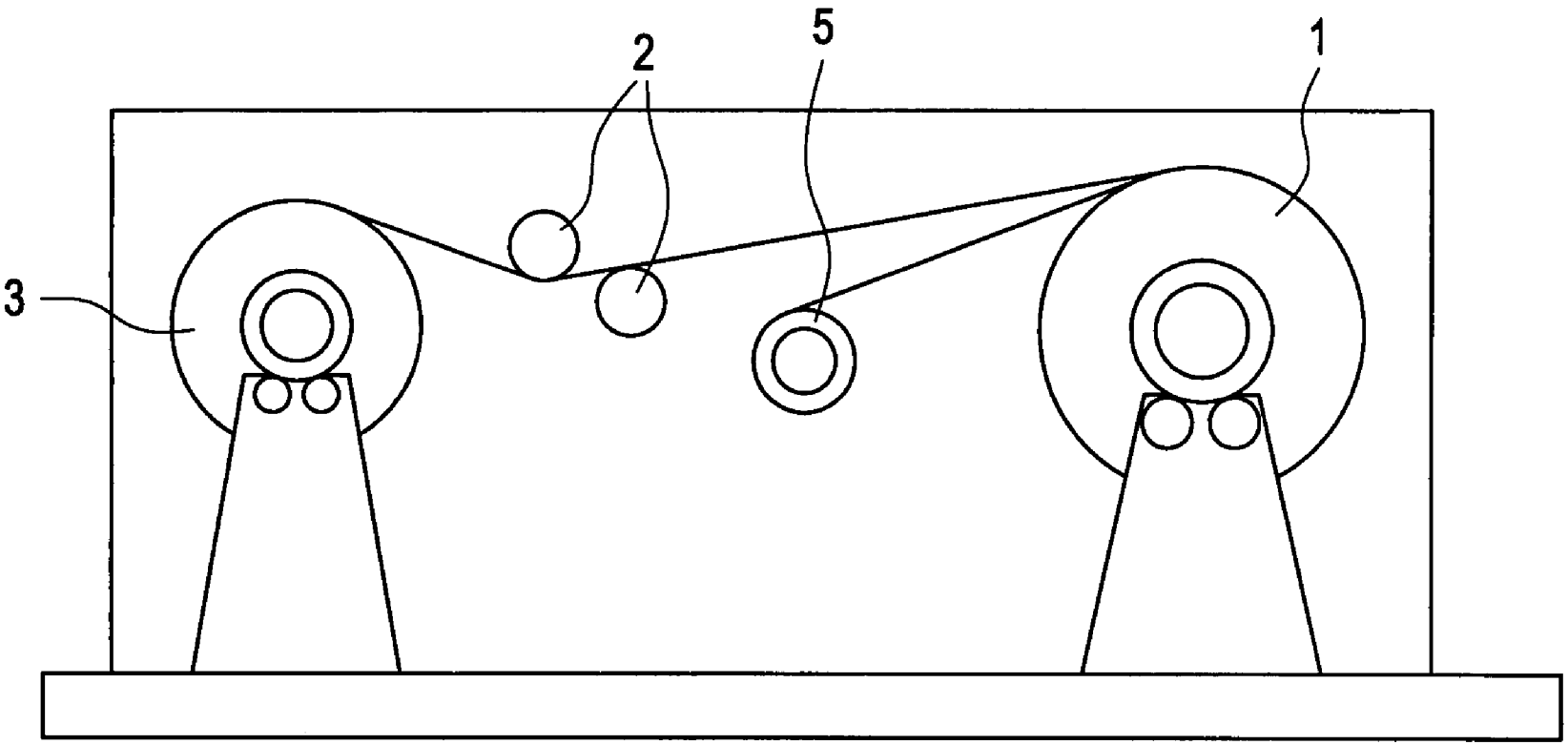
FIG. 1 is a schematic illustration of a method of making a magnetizing coil unit according to a first preferred embodiment of the present invention.

The present inventors have realized that the manufacturing method of a permanent magnet may be simplified if the unmagnetized blocks of permanent magnet precursor mate rial are first assembled to form a precursor body, and then the precursor body is magnetized to form the permanent magnet body. Magnetizing the precursor alloy body after assembling unmagnetized blocks together simplifies the assembly process since the unmagnetized blocks are easier to handle during assembly. Special precautions need not be taken to prevent the blocks from demagnetizing if blocks of unmagnetized (or even partially magnetized) material are assembled. Furthermore, improved field homogeneity and reduced shimming time may be achieved by machining the precursor body into a desired shape for use in an imaging system prior to magnetizing the precursor body. Since the precursor body is unmagnetized, it may be readily machined into a desired shape without concern that it would become demagnetized during machining.

Preferably, the precursor body is magnetized after it is attached to the support or the yoke of the imaging system. Also it is preferable that the permanent magnets precursor body is magnetized by temporarily providing a magnetizing coil around the unmagnetized precursor body and then applying a pulsed magnetic field to the precursor body from the coil to convert the precursor body into the permanent magnet body. Magnetizing the precursor alloy body after mounting it in the imaging system greatly simplifies the mounting process and also increases the safety of the process because the unmagnetized bodies are not attracted to nearby iron objects. Therefore, there is no risk that the unattached bodies would become flying missiles aimed at nearby iron objects. Furthermore, the unattached, unmagnetized bodies do not stick in the wrong place on the iron yoke because they are unmagnetized. Thus, the use of the special robot and/or the crank may be avoided, decreasing the cost and increasing the simplicity of the manufacturing process.

The present inventors have realized that the manufacturing method of the magnetizing coil can be simplified if the magnetizing coil is fabricated by pancake winding sheets of copper rather than winding wire. Preferably, the sheet has a width that is at least 10 times greater than its thickness. By using sheets of copper rather wire, coils can be fabricated with fewer or even no joints. Further, pancake winding is simpler and typically results in a higher packing factor. Additionally, manufacturing can be simplified by co-winding insulation with the copper sheet.

A method of making a magnetizing coil unit according to a preferred embodiment of the invention will now be described. In this embodiment, the magnetizing coil unit is formed by pancake wrapping a metal sheet, such as a copper sheet to form a solenoid coil. Unlike conventional magnetizing coil units which comprise many loops of wire per layer, only a single copper sheet is preferably wound per layer. That is, the width of the copper sheet is preferably equal to the height of the solenoid coil. Bare or film insulated copper is preferably used as the metal for the solenoid coil. However, other suitable metals may also be used.

In order that the current does not short across the layers of the copper sheet, it is preferable to provide insulation between the layers. FIG. 1 illustrates one method of providing this insulation. In this embodiment, insulation sheet 5 is co-wound with a copper sheet 3 from respective spools to form the solenoid coil 1. Optional rollers 2 may be used to guide the copper sheet 3 onto a bobbin during the winding. Preferably, the insulation sheet 5 is porous to allow the penetration of coolant between layers of copper sheet 5. However, the insulation sheet may be solid. Preferably, the insulation sheet 5 is a porous fiberglass sheet.

In another embodiment of the invention, insulation is applied to the copper sheet 3 as a film before winding. In still another embodiment of the invention, the insulation may be spiral wrapped as a tape around the bare or film insulated copper sheet. Preferably, the spiral wrapping covers 20–50% of the surface of the copper sheet 3. However any amount of coverage up 100% may be used.

Figure 2:
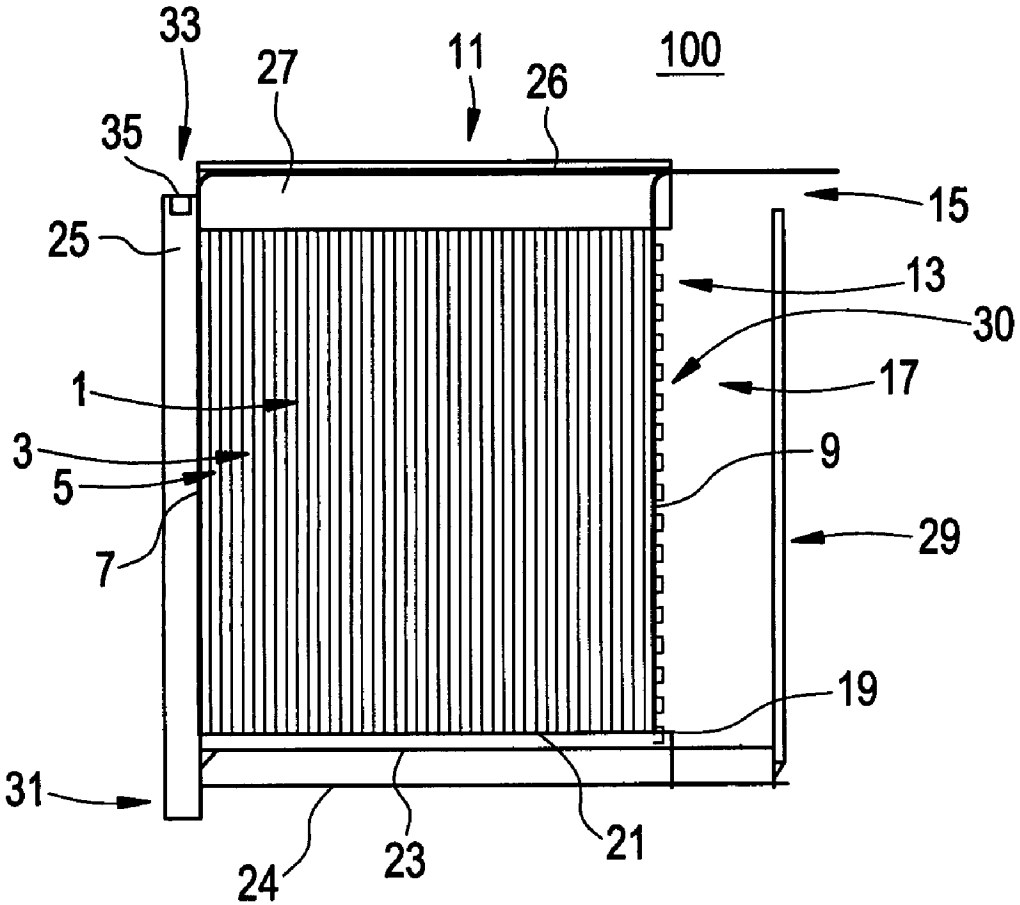
FIG. 2 is a schematic illustration of a magnetizing coil unit according to a second preferred embodiment of the present invention.

FIG. 2 illustrates a cross section of a magnetizing coil unit 100 according a preferred embodiment of the invention. The magnetizing unit 100 includes the solenoid coil 1 and a housing 11. The solenoid coil 1 has a start lead 7 in the inside of the coil of copper sheet 3 and a finish lead 9 on the outside of the coil 1 of copper sheet 3. The solenoid coil 1 is located in a cavity 13 in the housing 11. The housing 11 includes a gap 15 through which a coolant can be added to a coolant input reservoir portion 17 of the housing 11. Preferably, the coolant is liquid. More preferably, the coolant is liquid nitrogen.

In this embodiment, liquid coolant added to the coolant input reservoir portion 17 of the housing 11 flows into a coolant input port 19 in the bottom or adjacent to the wall 23 of the housing. The coolant input port 19 may be a conduit containing a plurality of microchannels 21. Therefore, coolant entering the input port 19 flows through the microchannels 21 into the cavity 13. Preferably, the number of microchannels 21 corresponds to the number of layers of copper sheet 3 or layers of insulation 5 in the solenoid coil 1, and the microchannels 21 are aligned with or are perpendicular to porous insulation layers 5 to allow the coolant to flow upwards between each of the layers of copper sheet 3 through the porous insulation sheet 5. Preferably axial cooling channels, nearly parallel to the coil axis, are formed in the porous insulation 5 and/or between copper sheet windings 3 if the insulation 5 is omitted.

During pulsed operation of the solenoid coil 1, pulse heat is generated in the solenoid coil 1. In the preferred embodiment of the invention, liquid nitrogen adjacent to the coiled copper sheet 3 absorbs the heat. Typically, some of the liquid nitrogen absorbs enough heat to evaporate, cooling the solenoid coil 1 by pool boiling cooling. Gaseous nitrogen is allowed to exit the housing 11 through an output port 26 at the top of the housing 11. Additional nitrogen then is added to the housing 11 from a reservoir (not shown) in order to replace the evaporated nitrogen. In this manner, it is possible to pulse the magnetizing coil unit 100 several times without having to remove it from around the material being magnetized.

Preferably, the inner wall 25 and bottom flange 24 of the housing 11 are made of stainless steel, such as 304L stainless steel. However, any other suitable material may be used. Covering the inner surface of the inner wall 25 is a thin insulating layer (not shown). The thin insulating layer may be Nomex paper or any other suitable insulating material. The bottom 23 and top 27 walls of the housing 11 and the ports 19, 26 are preferably made of G-10 or Textolite in which it is easy to form the microchannels. However, any suitable material may be used. The outer wall 29, bottom flange 24, and the inner wall 25, are preferably made of 304L stainless steel. Preferably, an insulating material 30, such as fiberglass overwrap is provided between the finish lead 9 and the coolant input reservoir portion 17. The solenoid 1 and the corresponding copper sheet width may have any suitable dimensions. For example, the solenoid height may be similar to a height of the precursor body that will be magnetized. Typically, the solenoid height and the copper sheet width may range between 10 and 25 cm, preferably 18 to 22 cm. The copper sheet 3 may have any suitable thickness, such as 0.1 mm to 2 mm, preferably 0.7 to 1 mm. The insulation layer 5 may have any suitable thickness, such as 0.05 to 0.5 mm, preferably 0.1 to 0.3 mm. The solenoid coil 1 may have any suitable number of turns, such as 50 to 500 turns, preferably 100 to 250 turns.

Figure 3:
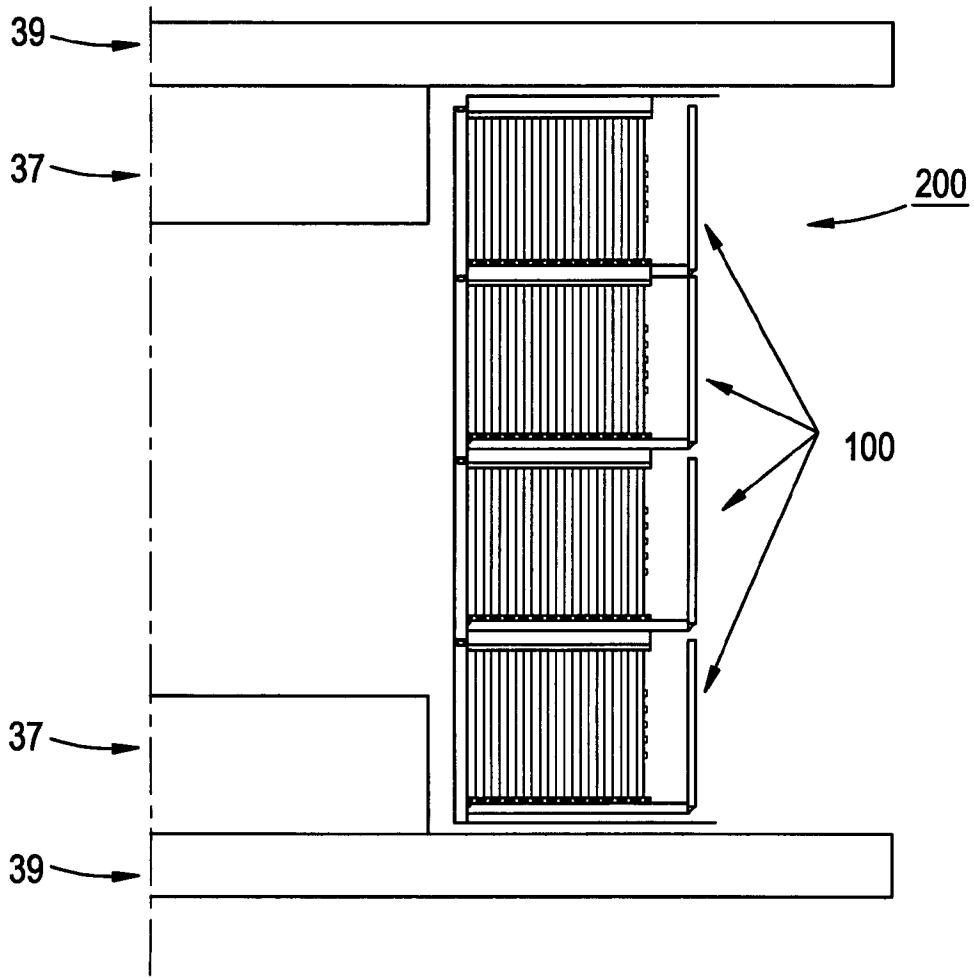
FIG. 3 is a schematic illustration of a magnetizing coil unit assembly according to a third preferred embodiment of the present invention.

FIG. 3 illustrates another embodiment of the invention. This embodiment is a magnetizing assembly 200 which includes a plurality of magnetizing coil units 100. The figure illustrates a magnetizing assembly 200 with four magnetizing coil units 100. However, any number of units 100 may be stacked. In one embodiment of the invention, the magnetizing coil units 100 are simply stacked on top of each other. In a preferred embodiment of the invention, the magnetizing coil units 100 are provided with a locking mechanism which helps to keep the magnetizing coil units 100 together.

One preferred locking mechanism is illustrated in FIG. 2. This mechanism includes a protrusion 31 in the bottom wall 23 and an opening 33 in the top wall 27 of the housing 11. The opening 33 may be a continuous groove around the periphery of the top wall 27 while the protrusion 31 may be a continuous tongue around the periphery of the bottom wall 23. Optionally, a groove 35 may be included in the opening 33 for an O-ring.

In another embodiment of the invention, the opening 33 may be a hole or a plurality of holes and the protrusion 31 may be a post or a plurality of posts. Additionally, the location of the opening 33 and the protrusion 31 may be reversed. That is, the opening 33 may be located on the bottom wall 23 while the protrusion may be located on the top wall 27.

Figure 4:
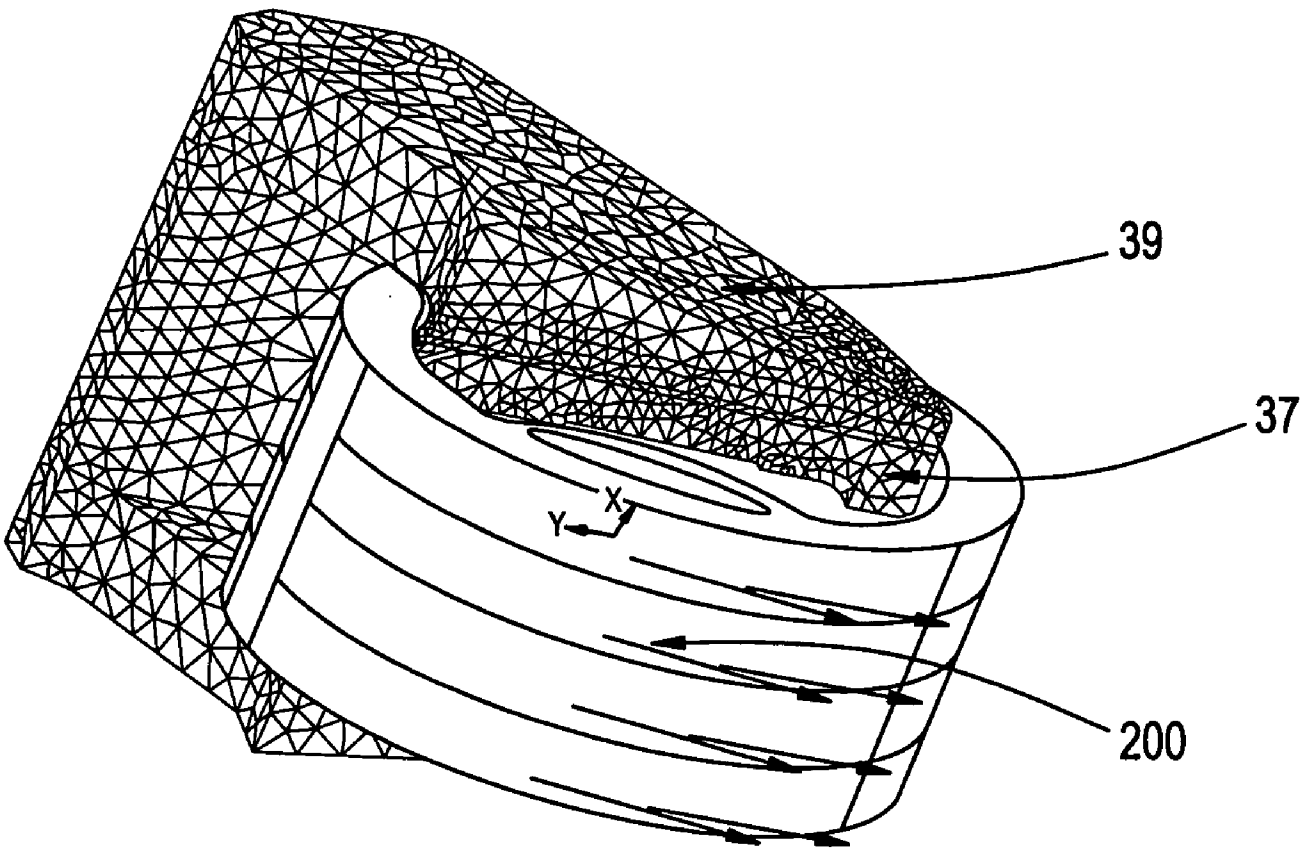
FIG. 4 is a perspective view of a magnetizing coil unit assembly according to a third preferred embodiment of the present invention.

In a preferred aspect of the invention, the magnetizing assembly 200 is used to magnetize permanent magnets for use in an imaging system, such as an MRI, MRT or NMR system. This embodiment is illustrated in FIGS. 3 and 4. An unmagnetized or partially magnetized precursor body 37 is assembled and is securely attached to a yoke 39. Then individual magnetizing coil units 100 are fitted around the unmagnetized or partially magnetized precursor body 37 to form the magnetizing assembly 200. The coolant reservoir (not shown) is connected to each of the individual magnetizing coil units 100 in the assembly 200 and the magnetizing coil units cooled to approximately 77 K. When the coils have cooled sufficiently to lower the resistivity of the copper sheet 3, the current is pulsed to provide a pulsed magnetic field, magnetizing the unmagnetized or partially magnetized precursor body 37.

If the imaging system, such as an MRI system, contains more than one permanent magnet, then such magnets may be magnetized simultaneously or sequentially. For example, as shown in FIGS. 3 and 4, four magnetizing coil units 100 may be used to simultaneously magnetize two precursor bodies 37 that are attached to opposite yoke 39 portions. Alternatively, one magnetizing coil unit 100 may be sequentially placed around each precursor body 37 of the imaging system to sequentially magnetize each precursor body. The precursor bodies 37 may be magnetized before or after placing optional pole pieces into the MRI system.

Figure 5:
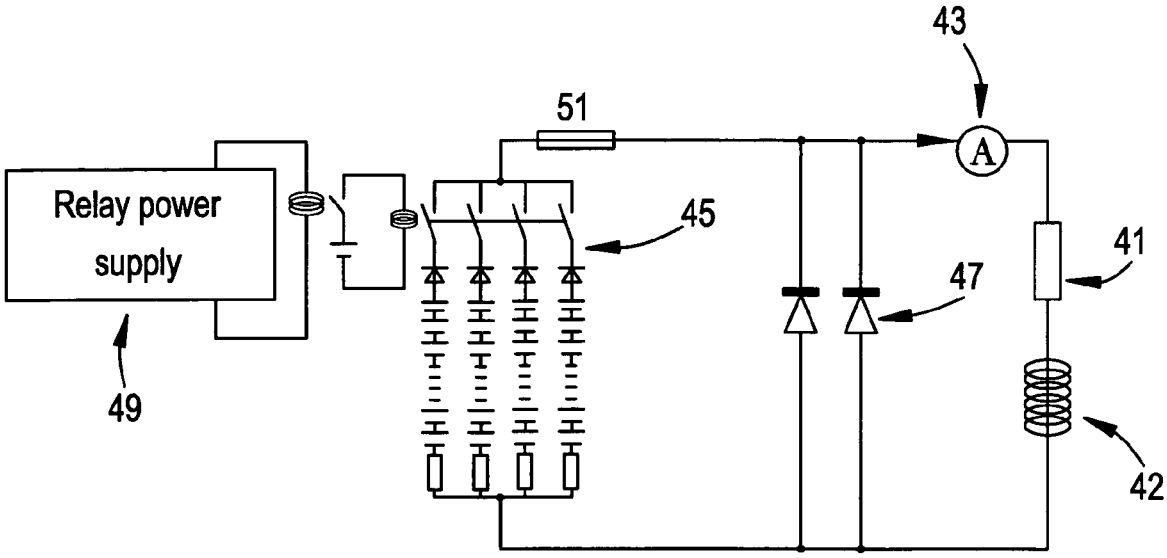
FIG. 5 is a circuit diagram of the pulsed magnet assembly of FIG. 3.

FIG. 5 illustrates a circuit diagram of the magnetizing assembly 200 according to another aspect of the invention. However, any other suitable circuit may be used for the magnetizing assembly 200, as desired. In this circuit, power supply 49 supplies power to a bank of rechargeable batteries or capacitors 45. The batteries or capacitors 45 may be arranged in series or parallel or a combination of both series and parallel.

The magnetizing assembly is operated through a switching mechanism 51. The switching mechanism may comprise a thyristor or a magnetically operated switch. Optionally, diodes 47 may be included in parallel to discharge the current from the pulse coil when the power supply is disconnected from the circuit at the end of the pulse. When the switch is closed, the current flows through the magnetizing coil 100, illustrated as impedance 42 and resistance 41. Optionally, an ammeter 43 is provided to monitor the current through the circuit. At the end of the pulse, the switch is opened to disconnect the power supply and discharge the coil current through the diodes.

Figure 6:
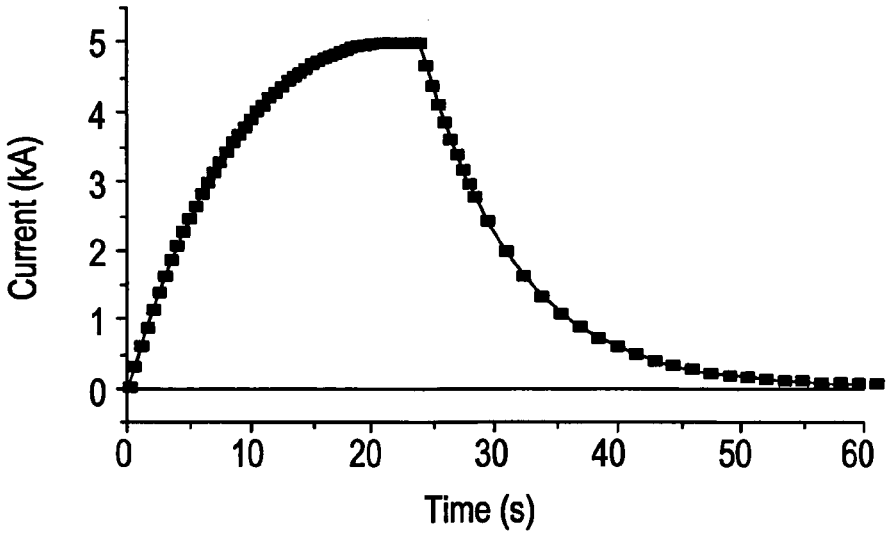
FIG. 6 is a plot of current versus time of a preferred embodiment of the invention.

FIG. 6 illustrates a magnetizing pulse according to a preferred aspect of the invention. The pulse reaches a maximum current of approximately 5 kA in approximately 20 seconds. The maximum current is held roughly constant for approximately 5 seconds and then decays back to zero in approximately 35 seconds. One or more pulses may be used to magnetize the precursor body 37.

In one preferred aspect of the present invention, the precursor body 37 and the permanent magnet material may comprise any permanent magnet material or alloy, such as CoSm, NdFe or RMB, where R comprises at least one rare earth element and M comprises at least one transition metal, for example Fe, Co, or Fe and Co. Most preferably, the permanent magnet comprises a praseodymium (Pr) rich RMB alloy as disclosed in U.S. Pat. No. 6,120,620, incorporated herein by reference in its entirety. The praseodymium (Pr) rich RMB alloy comprises about 13 to about 19 atomic percent rare earth elements (preferably about 15 to about 17 percent), where the rare earth content consists essentially of greater than 50 percent praseodymium, an effective amount of a light rare earth elements selected from the group consisting of cerium, lanthanum, yttrium and mixtures thereof, and balance neodymium; about 4 to about 20 atomic percent boron; and balance iron with or without impurities. As used herein, the phrase "praseodymium-rich" means that the rare earth content of the iron-boron-rare earth alloy contains greater than 50% praseodymium. In another preferred aspect of the invention, the percent praseodymium of the rare earth content is at least 70% and can be up to 100% depending on the effective amount of light rare earth elements present in the total rare earth content. An effective amount of a light rare earth elements is an amount present in the total rare earth content of the magnetized iron-boron-rare earth alloy that allows the magnetic properties to perform equal to or greater than 29 MGOe $(BH)_{max}$ and 6 kOe intrinsic coercivity (Hci). In addition to iron, M may comprise other elements, such as, but not limited to, titanium, nickel, bismuth, cobalt, vanadium, niobium, tantalum, chromium, molybdenum, tungsten, manganese, aluminum, germanium, tin, zirconium, hafnium, and mixtures thereof. Thus, the permanent magnet material most preferably comprises 13–19 atomic percent R, 4–20 atomic percent B and the balance M, where R comprises 50 atomic percent or greater Pr, 0.1–10 atomic percent of at least one of Ce, Y and La, and the balance Nd. Preferably, the precursor body 37 and the permanent magnet body comprise a plurality of blocks forming a stepped imaging surface, as described in U.S. Pat. No. 6,525,634, incorporated herein by reference in its entirety.

In another preferred aspect of the invention, the inventors have discovered that magnetization of the permanent magnets in an imaging system may be stabilized by applying a recoil pulse to the permanent magnet after it is magnetized. That is, a second pulse having a smaller magnitude and the opposite direction is applied to the precursor after the initial pulse.

In another preferred aspect of the invention, the inventors have discovered that the energy required for magnetization may be reduced by magnetizing the precursor above room temperature. Preferably, the precursor body 37 is heated above room temperature and below the Curie temperature of the permanent magnet material, such as 40–200° C.

The preferred embodiments have been set forth herein for the purpose of illustration. However, this description should not be deemed to be a limitation on the scope of the invention. Accordingly, various modifications, adaptations, and alternatives may occur to one skilled in the art without departing from the scope of the claimed inventive concept.

What is claimed is:

1. A magnetizing assembly comprising a plurality of magnetizing coil units, each of the magnetizing coil units comprising a coiled copper sheet located in a housing, the housing containing a coolant input port in a bottom of the housing, a plurality of microchannels in the coolant input port, a coolant output port located in a top of the housing, and a plurality of microchannels in the coolant output port, wherein the plurality of magnetizing coil units are stacked upon each other; and, either a top portion or a bottom portion of each housing includes an opening or a protrusion, wherein the opening comprises a groove and the protrusion comprises a tongue; and the protrusion on the housing of one magnetizing coil unit is adapted to fit into the opening on the housing of an adjacent magnetizing coil unit in the assembly.

2. The magnetizing assembly of claim 1 further comprising a coolant reservoir in an outer portion of the magnetizing coil units.

* * * * *